United States Patent [19]

Seavey

[11] Patent Number: 4,740,795

[45] Date of Patent: Apr. 26, 1988

[54] DUAL FREQUENCY ANTENNA FEEDING WITH COINCIDENT PHASE CENTERS

[75] Inventor: John M. Seavey, Cohasset, Mass.

[73] Assignee: Seavey Engineering Associates, Inc., Cohasset, Mass.

[21] Appl. No.: 868,256

[22] Filed: May 28, 1986

[51] Int. Cl.[4] ..... H01Q 13/02

[52] U.S. Cl. ..... 343/786; 343/762; 343/772; 343/776

[58] Field of Search ..... 343/762, 771, 772, 773, 343/776, 786

[56] References Cited

U.S. PATENT DOCUMENTS

| | | | |
|---|---|---|---|
| 3,803,617 | 4/1974 | Fletcher et al. | 343/786 |
| 3,864,687 | 2/1975 | Walters et al. | 343/786 |
| 4,041,499 | 8/1977 | Liu et al. | 343/786 |
| 4,168,504 | 9/1979 | Davis | 343/786 |
| 4,412,222 | 10/1983 | Möhring | 343/786 |
| 4,414,516 | 11/1983 | Howard | 343/786 |
| 4,504,836 | 3/1985 | Seavey | 343/786 |

FOREIGN PATENT DOCUMENTS

| | | | |
|---|---|---|---|
| 0057121 | 8/1982 | European Pat. Off. | 343/786 |

OTHER PUBLICATIONS

"The Phase Center of Horn Antennas", Muehldorf, E., IEEE *Transactions on Antennas & Propagation,* vol. AP-18, No. 6, 11/70.

"The Phase Center of Conical Horn Antennas", Ohtera, I., et al., *Electronics & Communications in Japan,* vol. 58-B, No. 2, 1975.

Rudge, A. W., et al., *The Handbook of Antenna Design,* vol. I, Peregrinus Press, London, UK, 1982, pp. 654–659.

Proper Feed Selection: First Step to Optimun System Performance, Seavey, J., TRVO Tecnology, 8/86.

The Seavey ESR 124 Dual Band Feed, Satellite World, Mar. 1985, pp. 32–35.

The Seavey 124 Prime/Prime Feeds, Satellite Direct, Feb. 1987, pp. 54–57.

*Primary Examiner*—William L. Sikes
*Assistant Examiner*—Doris J. Johnson
*Attorney, Agent, or Firm*—Charles Hieken

[57] ABSTRACT

A dual frequency antenna feed includes colinear axially spaced coaxial and circular waveguide cavities separated by a conducting portion having a high frequency rectangular waveguide therein extending radially outward. The coaxial cavity includes a tubular inner conductor having a polarization rotator connected to the rectangular waveguide for propagating high frequency energy. Four small coaxial transmission lines equiangularly disposed about the cavity axes and terminating in probes about a quarter wavelength from the end of each cavity intercouples the circular and coaxial cavities. The end of the coaxial waveguide cavity forms an aperture for high frequency energy from the conducting inner tube and for the low frequency energy from the region between the conducting inner tube and the cylinder surrounding the outside of the cavity. The radiating aperture is surrounded by a set of concentric conducting rings.

18 Claims, 2 Drawing Sheets

DUAL FREQUENCY ANTENNA FEEDING WITH COINCIDENT PHASE CENTERS

This invention relates in general to antenna feeding and more particularly concerns a dual frequency, prime focus, remotely adjustable polarization, antenna feed assembly having the two phase center locations of the feed coincident and resulting in coincident secondary radiation pattern main beams.

It is an important object of this invention to provide improved apparatus and techniques for dual frequency antenna feeding.

According to the invention, there is a microwave resolver having first and second colinear microwave cavities comprising circular and coaxial waveguides respectively. A conducting partition between the circular and coaxial waveguides comprises a higher frequency waveguide. A plurality of coaxial lines arranged around the periphery of each of the colinear microwave cavities, parallel to the cavity axis and equally spaced about it comprise means for electromagnetically coupling the two cavities, each of the small coaxial lines being approximately $\frac{1}{4}$ waveguide wavelength from the bottom of each cavity and having inner conductors terminating in electric field probe extensions arranged radially within each cavity. The microwave resolver device comprises means for transforming the microwave field from a $TE_{11}$ circular waveguide mode in the circular waveguide to an identically polarized $TE_{11}$ coaxial waveguide mode in the coaxial waveguide. According to a specific aspect of the invention, the higher frequency waveguide comprising the cavity partition is connected to the inner conductor of the coaxial cavity to define a higher frequency transmission path inside the tubular inner conductor. According to another aspect of the invention the conducting partition is rectangular and comprises a polarization rotator assembly means allowing rotation of the polarization within the tubular inner conductor. Preferably, the circular and coaxial waveguide outer cavity portions may be connected to a low frequency polarization rotator. The coaxial waveguide end may be connected to or form a radiating aperture including the tubular inner conductor comprising a high frequency aperture and the coaxial section forming a lower frequency aperture, both radiating appropriate $TE_{11}$ waveguide modes. Preferably, the phase center of the aperture comprising the tubular inner conductor and the phase center of the aperture comprising the coaxial waveguide are both at the same axial location for providing an apparent focal point in the two respective high frequency bands. The radiating aperture is preferably surrounded by a set of concentric metal rings having a depth approximately $\frac{1}{4}$ to $\frac{3}{8}$ wavelength and a spacing in the radial direction less than $\frac{1}{2}$ wavelength. Preferably the coaxial cavity inner conductor includes a single metal choke tube having an approximate depth of $\frac{1}{4}$ wavelength at the high frequency band and a dimeter which is somewhat greater than the inner conductor diameter to comprise means for suppressing currents flowing into the coaxial waveguide cavity.

Numerous other features, objects and advantages of the invention will become apparent from the following specification when read in connection with the accompanying drawing in which.

Figure 1:
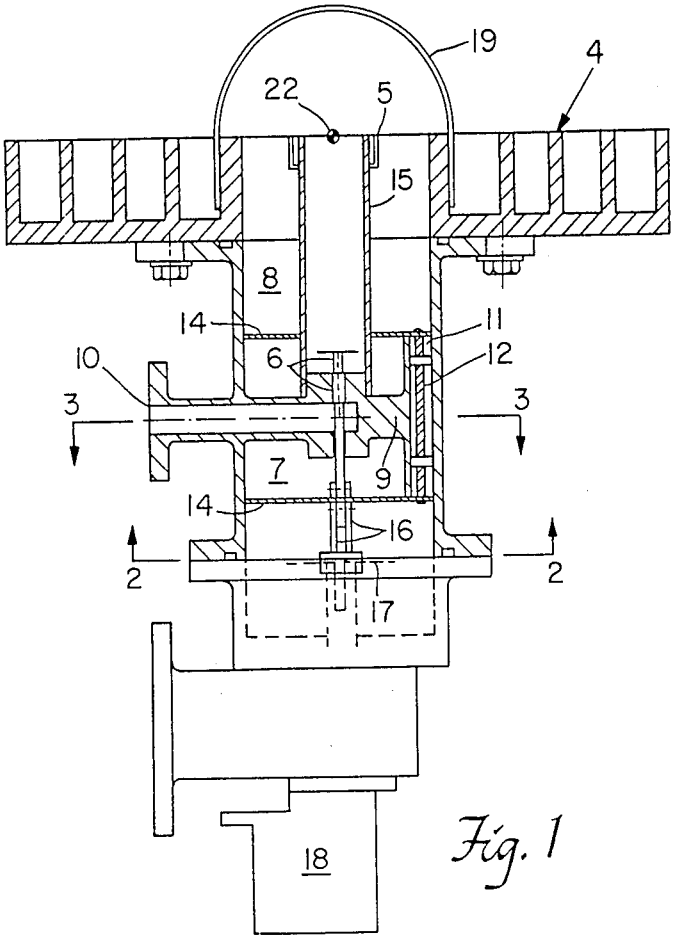
FIG. 1 is an axial sectional view of a dual frequency band feed according to the invention.
Figure 2:
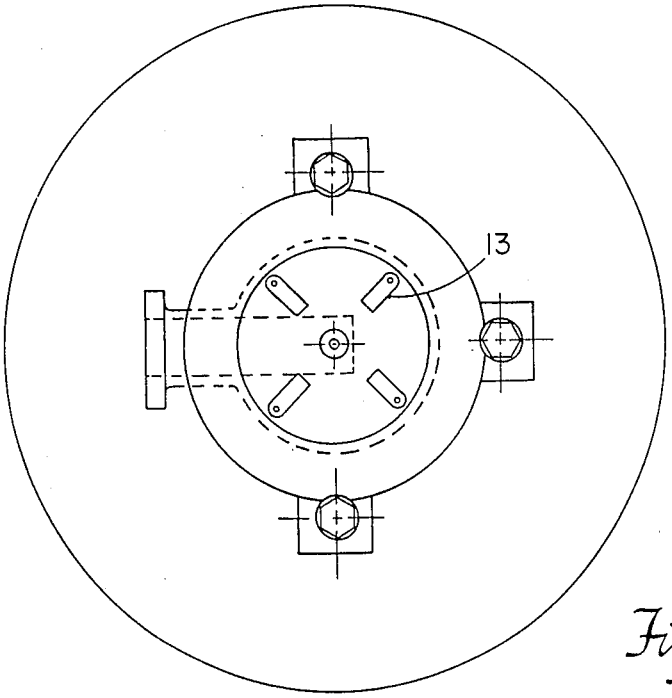
FIG. 2 is a sectional view through section 2—2 of FIG. 1.

With reference now to the drawing and more particularly FIGS. 1–4 thereof, there is shown various views of a feed according to the invention.

Figure 4:
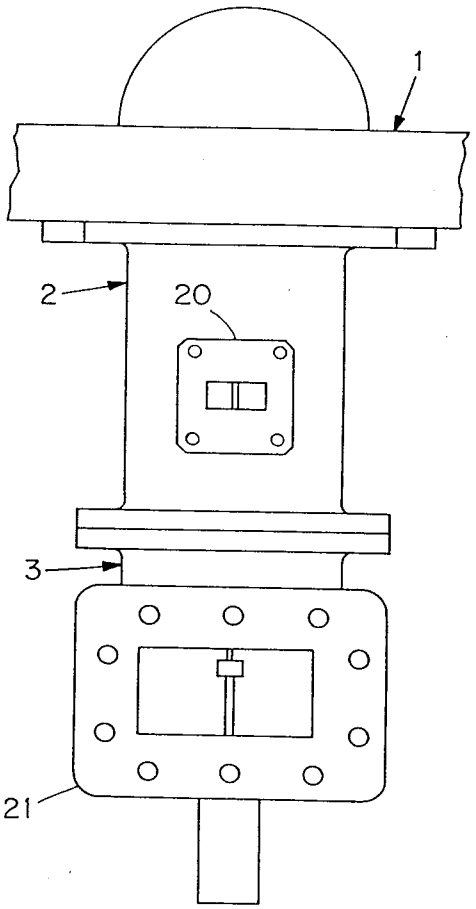
FIG. 4 is a front elevation view of the embodiment shown in FIG. 1 with part of the low-band polarization rotator subassembly removed.
Figure 3:
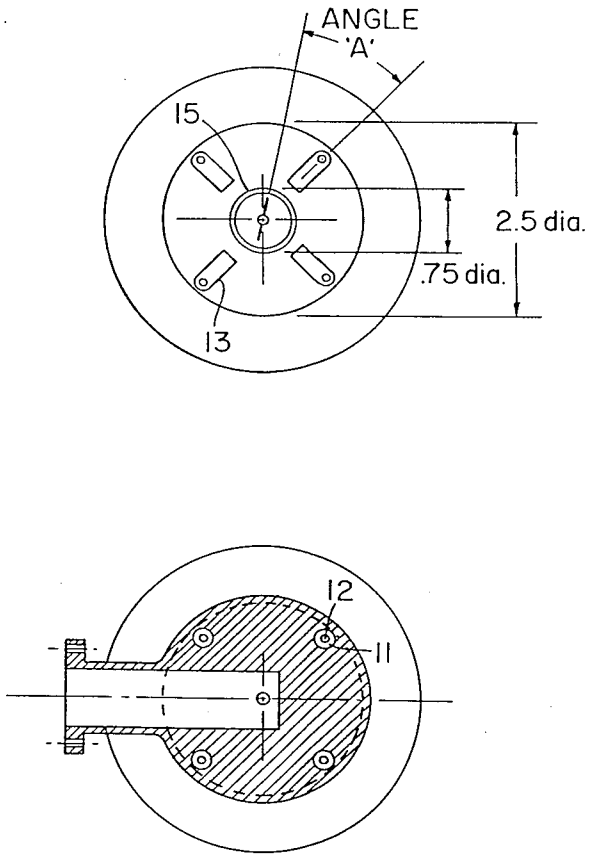
FIG. 3 is a view through section 3—3 of FIG. 1.

Referring to FIG. 4, the feed comprises three subassemblies:

(a) Low-band polarization rotator sub-assembly 1

(b) Microwave resolver sub-assembly 2

(c) Radiating aperture sub-assembly 3

In this invention, the low-band polarization rotator may be any available device, but may be the polarization rotator described in U.S. Pat. No. 4,504,836, for example.

Referring to FIG. 1 the radiating aperture assembly comprises a set of "scalar" metal rings 4; that is, a series of concentric grooves nominally $\frac{1}{4}$ to $\frac{3}{8}$ wavelength deep, whose function is to shape the primary radiation pattern and minimize feed spillover and maximize antenna efficiency. Such feed "scalar" rings are in common use and have been widely discussed in the literature.

The high-band radiating aperture is an open-ended circular waveguide surrounded by a $\frac{1}{4}$-wavelength deep choke 5; this waveguide is located coaxially with the low band radiating aperture, which is a coaxial waveguide.

The electromagnetic fields propagating within the high band circular aperture are designated the circular $TE_{11}$ mode. The mode of propagation within the low band aperture is the coaxial $TE_{11}$ mode and the dimensions of the respective circular tubes are selected to ensure that these desired modes propagate with cutoff frequencies nominally about 20% below the lowest operating frequency within each respective frequency band. The uppermost operating frequency is limited by the presence of transverse magnetic propagation modes and generally will set a bandwidth limit of about 30% on the respective operating frequency bands.

The central microwave "resolver" sub-assembly 2 is an important feature of this invention. Its function is to inject the desired coaxial $TE_{11}$ mode into the low band coaxial aperture waveguide and to provide a means for incorporating a high-band polarization rotator device 6 within the device. A feature of this device is that it performs these functions for all angles of linear polarization, since many applications of this feed involve Earth Station antenna use in which the polarization must be rotated remotely for alignment with that of the satellite signal.

It is convenient to define a polarization rotator as that device which converts a $TE_{11}$ rectangular waveguide mode signal into a remotely adjustable linear polarized $TE_{11}$ mode signal in a circular waveguide.

A resolver according to the invention comprises a set of two axially displaced co-linear metal cavities 7 and 8 separated by a relatively thick metal shorting plate. One of the cavities 7 comprises a circular cross-section waveguide; the opposite cavity 8 comprises a coaxial cross-section waveguide. The thick shorting plate 9 which separates the two cavities 7 and 8 contains a rectangular waveguide 10 for the high-band signal; this waveguide extends radially from the center of the device to a waveguide flange port 20 outside the device, as seen in FIG. 4.

There are four small coaxial transmission lines 11 situated 90 degrees from each other around the outside diameter of the circular cavities 7 and 8 and extending approximately halfway up (about ¼ low-band waveguide length) from the bottom of each cavity. The inner conductors 12 of these four coaxial lines are connected to a set of four radially disposed metal probes 13 formed onto (for example) a plastic laminate printed circuit board 14 of a low dielectric constant material such as fiberglass or Teflon composite. Their function is to "resolve" the $TE_{11}$ mode which exists in their respective cavity at an angle "A" with respect to the probe set into two components whose amplitudes are given by the following table:

| Probe Location | Angular Location of Probe | Amplitude of Probe Signal |
|---|---|---|
| 1 | 0 | COS (A) |
| 2 | 90 | SIN (A) |
| 3 | 180 | −COS (A) |
| 4 | 270 | −SIN (A) |

These resolved signals then propagate through the four coaxial lines to the opposite sets of probes where they are summed as vector fields into a $TE_{11}$ mode whose polarization is identical to the original "A" angle in the first cavity.

Thus, the low band signal within the resolver travels through the device without polarization rotation (independent of the incident polarization) and is transformed from a circular waveguide $TE_{11}$ mode in cavity 7 to a coaxial waveguide $TE_{11}$ mode in cavity 8.

The high band signal is injected into the central circular waveguide 15 (which forms the center "conductor" of the low band coaxial waveguide 8) by a polarization rotator similar in design (or the equal) to that of the low band device. For background on this device, reference is made to U.S. Pat. No. 4,504,836.

It is arranged for the polarization of the high and the low band signals to be remotely rotated by mechanically coupling shafts 16 of the two (low and high band) polarization rotators. This is accomplished by arranging the high band polarization rotator shaft so that it mechanically engages the probe dipole 17) element of the low band polarization rotator. Therefore, the actuator (motor or servo device) which rotates the low band polarization also rotates the high band polarization. In use, the two frequency band polarizations are usually aligned parallel to each other since most applications have common polarization alignment at the satellite or transmitting location. However, nothing prevents other low/high band alignments other than adjustment of the shaft coupling during assembly.

One of the principal uses of the invention is to receive signals from so-called "hybrid" geostationary communications satellites which emit signals in the 3.7–4.2 GHz (C-Band) and the 11.7–12.2 GHz (Ku-Band) frequency bands simultaneously. Other frequencies or combinations may, or course, be of interest as well.

These C- and Ku-Band signals may be received from a particular version of the subject invention which, as an example, will be described here for clarity and to illustrate a practical case.

The dimensions shown in FIG. 1 have been found to be preferred for this frequency band combination. The high and low band waveguide port flange 20 and 21 support a weather cover 19 over the radiating apertures.

Performance parameters for this particular feed which have been verified by actual measurement are as follows:

| PARAMETER | LOW-BAND | HIGH-BAND |
|---|---|---|
| Frequency | 3.7–4.2 GHz | 11.7–12.2 GHz |
| VSWR | 1.3, maximum | 1.3, maximum |
| Insertion Loss | 0.1 dB, maximum | 0.1 dB, maximum |
| Cross-Polarization | 25 dB, minimum | 30 dB, minimum |
| Isolation | 80 dB, minimum | 25 dB, minimum |
| Primary Patterns | Approximately $Cos^2$ (0) amplitude | |
| Phase Center 22 | Coincident within ±0.1 inch | |

There has been described novel apparatus and techniques for dual frequency antenna feeding having numerous electrical and mechanical advantages discussed above. It is apparent that those skilled in the art may now make numerous uses and modifications of and departures from the specific embodiments described herein without departing from the inventive concepts. Consequently, the invention is to be construed as embracing each and every novel features and novel combination of features present in or possessed by the apparatus and techniques herein disclosed and limited solely by the spirit and scope of the appended claims.

What is claimed is:

1. Dual frequency microwave resolving apparatus comprising, first and second axially spaced colinear microwave cavities, said first and second microwave cavities comprising circular and coaxial waveguides respectively, said first and second microwave cavities separated by conducting partition means comprising a high frequency waveguide for propagating microwave energy, a plurality of coaxial lines axially spaced around the periphery of said first and second microwave cavities parallel to the cavity axes equiangularly spaced about the cavity axes for electromagnetically intercoupling the first and second microwave cavities, each of said coaxial lines extending approximately a quarter guide wavelength from the end of each cavity with the inner conductor of each coaxial line terminating in an electric field probe extension arranged radially within each cavity, whereby identically polarized $TE_{11}$ circular waveguide and $TE_{11}$ coaxial waveguide modes are established in said first and second cavities, respectively.

2. Dual frequency microwave resolving apparatus in accordance with claim 1 wherein the high frequency waveguide in said conducting partition means is connected to a metal tube forming the inner conductor of said second cavity for establishing a high frequency transmission path in said tubular inner conductor.

3. Dual frequency microwave resolving apparatus in accordance with claim 2 wherein the end of said coaxial waveguide comprises a radiating aperture with the tubular inner conductor comprising a high frquency aperture and the coaxial section forming a low frequency aperture with both radiating appropriate $TE_{11}$ waveguide modes.

4. Dual frequency microwave resolving apparatus in accordance with claim 3 wherein the radiating aperture is proportioned so as to place the phase center of the aperture comprising the tubular inner conductor and the phase center of the aperture comprising the coaxial waveguide formed by the tubular inner conductor and the outside cylinder of the second cavity both at the same axial location for effectively providing a focal point in the respective high and low frequency bands.

5. Apparatus in accordance with claim 4 wherein the radiating aperture is surrounded by a set of concentric conducting rings having a depth approximately $\frac{1}{4}$ to $\frac{3}{8}$ wavelength at the low microwave frequency and the spacing in the radial direction is less than $\frac{1}{2}$ wavelength at the low microwave frequency.

6. Dual frequency microwave converting apparatus in accordance with claim 5 wherein the tubular inner conductor includes a single metal choke tube having an approximate depth of $\frac{1}{4}$ wavelength at the high frequency band and a diameter which is somewhat greater than the inner conductor diameter for suppressing high frequency currents flowing into the second cavity.

7. Dual frequency microwave converting apparatus in accordance with claim 4 wherein the tubular inner conductor includes a single metal choke tube having an approximate depth of $\frac{1}{4}$ wavelength at the high frequency band and a diameter which is somewhat greater than the inner conductor diameter for suppressing high frequency currents flowing into the second cavity.

8. Dual frequency microwave resolving apparatus in accordance with claim 1 wherein the high frequency waveguide within said conducting partition means is rectangular and comprises a polarization rotator assembly permitting rotation of the polarization within the inside of a conducting tube forming the inner conductor of said second cavity.

9. Dual frequency microwave resolving apparatus in accordance with claim 8 and further comprising a low frequency polarization rotator connected to said first and second cavities.

10. Dual frequency microwave resolving apparatus in accordance with claim 9 wherein the end of said coaxial waveguide comprises a radiating aperture with the tubular inner conductor comprising a high frequency aperture and the coaxial section forming a low frequency aperture with both radiating appropriate $TE_{11}$ waveguide modes.

11. Dual frequency microwave resolving apparatus in accordance with claim 10 wherein the radiating aperture is proportioned so as to place the phase center of the aperture comprising the tubular inner conductor and the phase center of the aperture comprising the coaxial waveguide formed by the tubular inner conductor and the outside cylinder of the second cavity both at the same axial location for effectively providing a focal point in the respective high and low frequency bands.

12. Apparatus in accordance with claim 11 wherein the radiating aperture is surrounded by a set of concentric conducting rings having a depth approximately $\frac{1}{4}$ to $\frac{3}{8}$ wavelength at the low microwave frequency and the spacing in the radial direction is less than $\frac{1}{2}$ wavelength at the low microwave frequency.

13. Dual frequency microwave converting apparatus in accordance with claim 11 wherein the tubular inner conductor includes a single metal choke tube having an approximate depth of $\frac{1}{4}$ wavelength at the high frequency band and a diameter which is somewhat greater than the inner conductor diameter for suppressing high frequency currents flowing into the second cavity.

14. Dual frequency microwave resolving apparatus in accordance with claim 8 wherein the end of said coaxial waveguide comprises a radiating aperture with the tubular inner conductor comprising a high frequency aperture and the coaxial section forming a low frequency aperture with both radiating appropriate $TE_{11}$ waveguide modes.

15. Dual frequency microwave resolving apparatus in accordance with claim 14 wherein the radiating aperture is proportioned so as to place the phase center of the aperture comprising the tubular inner conductor and the phase center of the aperture comprising the coaxial waveguide formed by the tubular inner conductor and the outside cylinder of the second cavity both at the same axial location for effectively providing a focal point in the respective high and low frequency bands.

16. Apparatus in accordance with claim 15 wherein the radiating aperture is surrounded by a set of concentric conducting rings having a depth approximately $\frac{1}{4}$ to $\frac{3}{8}$ wavelength at the low microwave frequency and the spacing in the radial direction is less than $\frac{1}{2}$ wavelength at the low microwave frequency.

17. Dual frequency microwave converting apparatus in accordance with claim 16 wherein the tubular inner conductor includes a single metal choke tube having an approximate depth of $\frac{1}{4}$ wavelength at the high frequency band and a diameter which is somewhat greater than the inner conductor diameter for suppressing high frequency currents flowing into the second cavity.

18. Dual frequency microwave converting apparatus in accordance with claim 15 wherein the tubular inner conductor includes a single metal choke tube having an approximate depth of $\frac{1}{4}$ wavelength at the high frequency band and a diameter which is somewhat greater than the inner conductor diameter for suppressing high frequency currents flowing into the second cavity.

* * * * *